United States Patent [19]

Schmidt, Sr. et al.

[11] 3,978,874

[45] Sept. 7, 1976

[54] HEAT SENSITIVE FILM SHRINKING MACHINE

[76] Inventors: Jacob Schmidt, Sr.; Jacob Schmidt, Jr., both of R.D. No. 1, Harleysville, Pa. 19438

[22] Filed: June 23, 1975

[21] Appl. No.: 589,027

[52] U.S. Cl. ..... 134/107; 134/130; 134/131; 134/191; 134/199

[51] Int. Cl.[2] ..... B08B 3/02

[58] Field of Search ..... 134/105, 107, 108, 130, 134/131, 191, 199

[56] References Cited

UNITED STATES PATENTS

| | | | |
|---|---|---|---|
| 2,599,455 | 6/1952 | Husemann | 134/131 X |
| 2,745,419 | 5/1956 | Slingerland | 134/130 |
| 2,878,822 | 3/1959 | Ine | 134/105 X |
| 2,940,458 | 6/1960 | Speckman | 134/105 X |
| 3,043,319 | 7/1962 | Zebarth | 134/131 |
| 3,101,173 | 8/1963 | Jennings | 134/191 X |
| 3,468,320 | 9/1969 | Cumming | 134/199 X |
| 3,868,272 | 2/1975 | Tardoskegyi | 134/131 X |

*Primary Examiner*—Robert L. Bleutge
*Attorney, Agent, or Firm*—C. Hercus Just; Samuel M. Learned, Jr.

[57] ABSTRACT

A machine employing heated water as the medium for shrinking heat sensitive film wrapping on food products and the like, wherein the machine provides a hot water distribution and recirculation system incorporating a variable speed propeller pump operable to provide a combination of droplet type hot water sprinkling and cascaded hot water drenching in order to quickly and efficiently accomplish the close encasement shrinking of the heat sensitive film wrapping upon food product items conveyably transported through the shrinking chamber of the machine, thereby precluding thermal degradation of the food products with a consequent discoloring thereof when the same are otherwise exposed to elevated temperatures during the film shrinking operation.

2 Claims, 4 Drawing Figures

HEAT SENSITIVE FILM SHRINKING MACHINE

BACKGROUND OF THE INVENTION

The present invention relates to a machine for shrinking heat sensitive film around vacuum packaged food products such as poultry, lunch meats, and the like, wherein said machine delivers and recirculates a hot water medium to effect shrinking of said film in addition to also providing the conveying means whereby said film wrapped products are transported through the machine in order to operationally accomplish a quick and efficient exposure of said heat sensitive film wrapping to the hot water shrinking medium.

In general, shrink wrap packaging of food products within transparent film materials has become a popular and widespread merchandising method in that the same provides a highly protective food product covering, as well as enabling a high degree of consumer visibility of the food product wrapped therein.

In application, the subject food product is either mechanically or manually inserted into or wrapped within an impervious heat sensitive transparent plastic material. By means well known in the art the film wrapper is evacuated and clamped or sealed off, and then, the product thus packaged is introduced to a machine commonly known as a "shrink tunnel", such as those machines respectively shown in U.S. Pat. No. 2,789,407 to Smallegan, dated Apr. 23, 1957, and U.S. Pat. No. 3,678,244 to Worline, dated July 18, 1972, wherein heat, by one means or another, is provided and applied to the packaged product as the same is transported through said machine and the heat sensitive film is thereby shrunk tightly about the product packaged therein. As previously pointed out, the heat may be provided by one means or another, such as by heated water as taught in the patent to Smallegan supra, or, as taught in the patent to Worline supra, a combination of hot air and heated water, or any other suitable means.

It has been determined, however, that in the shrink wrap packaging of food products the heating means employed should be highly efficient so as to permit minimum exposure time of the food product to the heat source while still obtaining acceptable shrinking of the heat sensitive film material about the food product, thereby preventing thermal degradation of the food product by way of a partial cooking, which results in an unattractive discoloration of said food product and thereby defeats the primary purposes of employing a transparent shrink wrap material to provide a highly effective protective food product covering, while at the same time providing high consumer visibility of the food product packaged therein.

Another factor to be considered with regard to thermal degradation of food products during shrink wrap operations is that currently available heat sensitive transparent and translucent film materials, which are generally acceptable in shrink wrap applications for food products, is that said film materials have shrinking temperatures very close to the boiling point of water, which further makes the exposure time during shrinking operations a critical consideration if food product discoloration by way of thermal degradation is to be avoided.

The shrink wrap heating means thus far found to be most generally suitable in terms of efficiency, as well as practical considerations, is heated water and, generally, the heated water is applied to the wrapped food products within the shrink chamber area of the machine by means of a fine spray, or partial immersion, or a combination of both methods.

In the case of fine spray application, the heated water is drawn from a heat exchange reservoir of the machine, pressurized by conventional pumping means, and delivered under pressure to spray nozzles as in the Worline patent, supra. The fine spray method of application gives rise, however, to the following problems. First, since the heated water must be near the boiling point in order to provide effective film shrinking, and while the water is being impelled to a pressure differential through the pumping means, there is frequently steam flashing within the pump casing which either results in a loss of the pumping head, or alternately, a greatly reduced pumping efficiency. Also, the pumping horsepower requirements necessary to operate a pressurized spray application system of the type heretofore described is considerably greater than would otherwise be required if other than conventional high-pressure pumping means were employed. Additionally, the thermal efficiency of the fine spray type application system is relatively low due to the great amount of heat loss by way of the spray cooling effect inherent to the application method. The cone-shaped spray delivered by the spray head of the patent to Smallegan also does not use hot water in a very efficient manner, especially for rapid shrinking.

In the heated water immersion method, although highly effective in causing film shrinking, and highly efficient in heat transfer, there is the problem of obtaining a sufficiently short exposure time so that shrinkage of the film material may be effectively accomplished without also causing thermal degradation and discoloration of the food product wrapped therein.

The shortcomings and limitations set forth in teachings of the previous disclosures are obviated by a substantially improved heat sensitive film shrinking machine which comprises the present invention, the details of which are as follows

SUMMARY OF THE INVENTION

It is the principal object of the present invention to provide a machine for shrinking heat sensitive film around vacuum packaged food products and the like, wherein said machine continually recirculates a heated water medium maintainable at a uniform elevated temperature of 205°F, and the heated water recirculation means thereof is provided by a submerged variable speed propeller pump operable within a hot water reservoir stand pipe of said machine assembly to pump and deliver said heated water medium at a low pressure head concurrently to an upwardly disposed overflow weir communicating with a distribution tray for gravity fed cascaded hot water drenching of upwardly exposed portions of a plurality of conveyably transported heat sensitive film wrapped food product items, but, however, providing sufficient pressure to distribute also heated water through a fountain manifold for hot water sprinkling of the underside portions of the same, whereby the employment of said machine of the present invention provides quick and efficient accomplishment of the close encasement shrinking of said heat sensitive film upon said food product items vacuum wrapped therein in a sufficiently short period of time so as to preclude thermal degradation and consequent discoloring of said food products during exposure to elevated temperature of the heated water medium during conveyor transportation through the film shrinking chamber of said machine.

It is another object to provide a machine for shrinking heat sensitive film around vacuum packaged food products and the like wherein said machine incorporates a heated water recirculation pump means that delivers a greater volume of heated water at a significantly reduced horsepower requirement than previously employed recirculation pumping means for similar purposes, in a smooth variably controlled laminar flow pattern and absent cavitation and steam flashing in the pumping chamber which would otherwise thereby result in a loss of pumping head and pumping efficiency during operational employment.

A further object of the present invention is to provide a machine for shrinking heat sensitive film around vacuum packaged food products which delivers said hot water medium to the shrinking chamber of said machine in such a manner as to minimize hot water, and air entrainment, consequent vaporization, and radiant loss of thermal energy therefrom.

An additional object of the present invention is to provide as an integral machine component a suitable conveying means for transporting heat sensitive film wrapped products through said machine in order to operationally accomplish film shrinking.

It is still another object of the present invention to provide a machine for shrinking heat sensitive film around vacuum packaged food products, which machine has a simple and durable construction, and is operable and maintainable by persons not possessed of special skills or training.

Details of the foregoing objects and of the invention, as well as other objects thereof, are set forth in the following specification and illustrated in the accompanying drawings comprising a part thereof.

DETAILED DESCRIPTION

Figure 1:
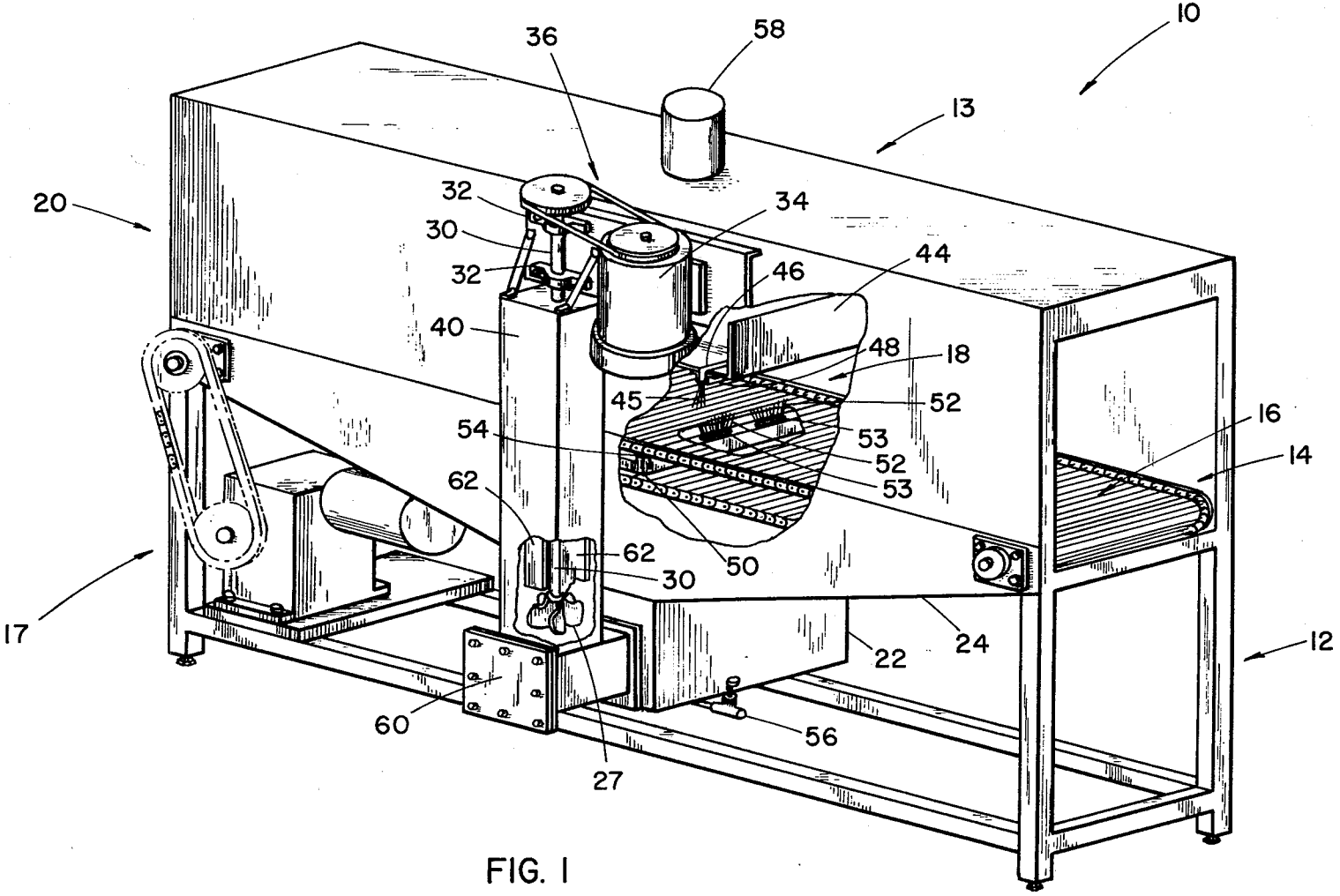
FIG. 1 is a rear perspective elevation of a machine embodying the principles of the present invention, particularly showing the hot water reservoir, recirculation system, fountain manifold, and distribution tray sub-assemblies thereof.

Referring to FIG. 1, the present invention is shown therein which comprises a heat sensitive film shrinking machine 10 having a supporting frame structure 12 comprised of interconnected horizontally and vertically disposed structural support members, an enclosing cabinet structure 13, an infeed conveyor station 14 to which items previously vacuum wrapped in heat sensitive film material are delivered into said machine 10 upon a linked rod conveyor 16 powered by a variable speed conveyor drive means 17 and thereafter said items are sequentially impelled in a longitudinally spaced relationship upon said conveyor 16 through the shrinking chamber 18 of said machine 10 and then further conveyed to the delivery end 20 thereof for additional processing operations such as labeling, packing, refrigeration, freezing, or the like.

Also refer to FIG. 1 to explain the details of the shrinking chamber operational sub-assembly components of the present invention, in addition to further explaining the manner in which said sub-assembly components functionally cooperate to mechanically provide the improved heat sensitive film shrinking capabilities obtained by employment of said machine 10.

Figure 2:
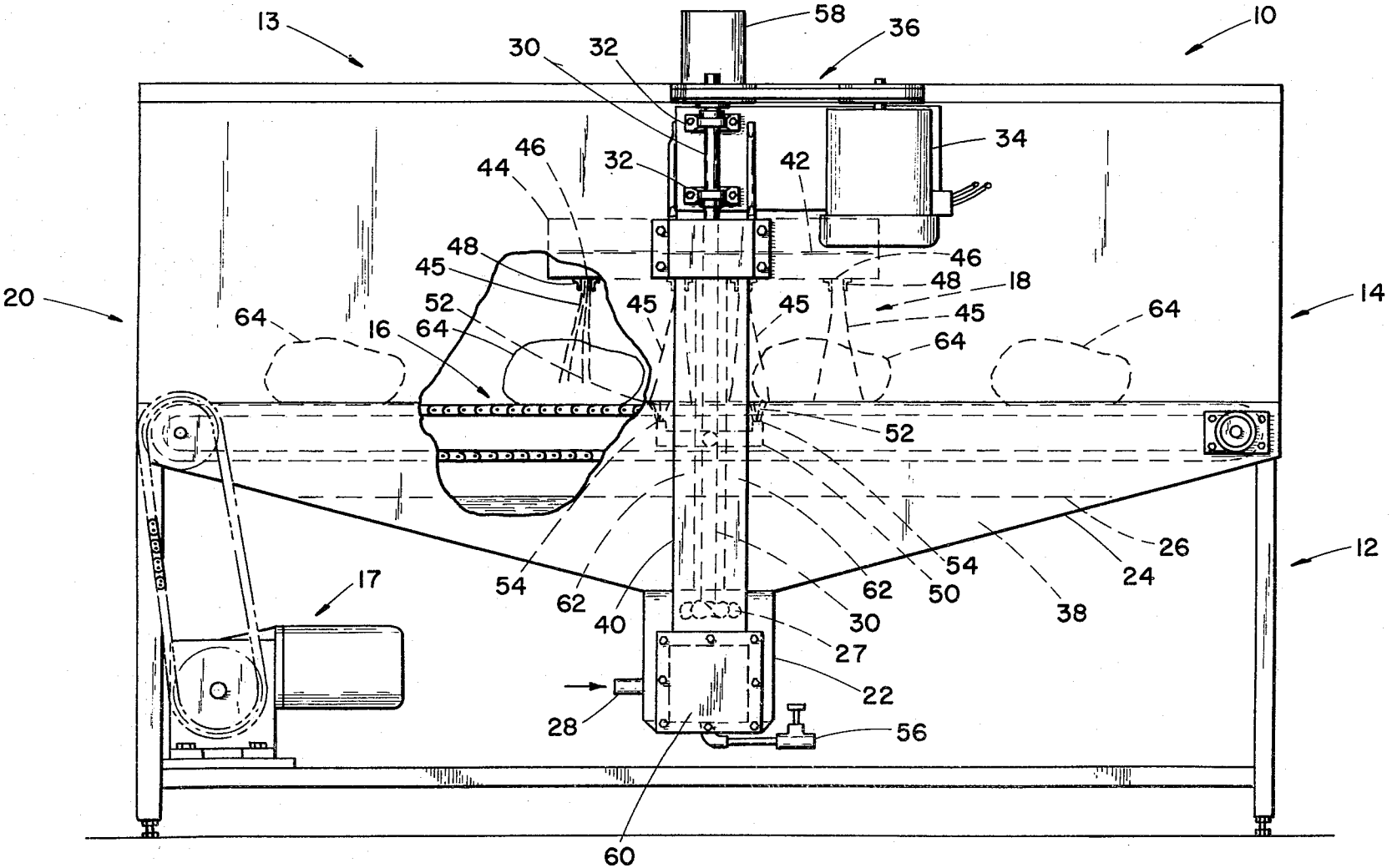
FIG. 2 is a side elevation of the illustration shown in FIG. 1, showing additional structural detail of said machine as well as the relative positioning of respective sub-assembly components thereof.

Initially, the reservoir 22 and the affixed collection basin 24 of said machine 10 structure are filled with clean water to an elevation generally indicated by the water level line 26, which line is not shown in FIG. 1, but, however, is seen in FIG. 2 and represents the water level when the recirculation propeller pump 27 is in operation and the machine 10 is functional for accomplishing film shrinking operations. Thereafter, live steam from an appropriate generating source, not shown, is introduced through the steam inlet valve coupling 28, also not shown in FIG. 1, but, however, likewise seen in FIG. 2. Live steam introduced through the steam inlet valve is absorbed and condensed by the water contained in the reservoir 22 and collection basin 24, thereby effecting a transfer of the heat of vaporization from said steam to said water and ultimately elevating and maintaining the temperature thereof at an operational shrinking temperature level of 205°F. In order to obtain a heated water temperature equiplibrium of 205°F throughout the reservoir and collection basin water mass during the pre-operational heating cycle, it would be normal pre-operational procedure to activate said recirculation system propeller pump 27 affixed to drive shaft 30 which is maintained in vertically aligned position by bearing members 32 and rotationally driven by variable speed motor 34 through pulley and belt drive train 36, which propeller pump activation would thereby cause recirculation of said water through the system during pre-operational heating and more readily enable attainment of operational temperature equilibrium within the heated water shrinking medium 38.

It should be noted that upon activation of said recirculation propeller pump 27, the heated water shrinking medium 38 is drawn from the reservoir 22 and has imparted thereto a sufficient pressure head to elevate said water up the hot water stand pipe 40 to the overflow weir 42 for delivery to the upwardly disposed distribution tray 44 with a resultant gravity flow 45 of heated water 38 which is cascaded downward through a plurality of elongated slots 46 to the collection basin 24. The pattern of cascaded heated water 38 from the distribution tray 44, through elongated slots 46 of suitable width, is established by flanges 48, see FIG. 4, affixed to the underside surface of said distribution tray 44, said flanges 48 being parallel to said slots and one or both being adjustable transversely by the use of short slots, so as to be spaced preferably equally apart along the longitudinal dimension of said tray 44.

Concurrent with the pumped delivery of heated water 38 to said distribution tray 44, there is also a pumped delivery of said heated water to the fountain manifold 50, and although said heated water is delivered at a relatively low pressure head to said fountain manifold 50, there is a sufficient pressure head imparted to the heated shrinking water medium 38 by the pumping action of said recirculation system propeller pump 27 to cause an upward delivery of a coarse droplet sprinkling 52 from a plurality of spaced openings 53 provided centrally along the longitudinal upper closure surface 54 of said manifold. Therefore, as an item which has been previously wrapped in a heat sensitive film material is thereafter conveyed through the shrinking chamber 18 of said machine 10 by means of the linked rod conveyor 16, said item with the heat sensitive film material vacuum wrapped thereabout, is concurrently enveloped by a cascaded discharge of heated water as well as a complementary upwardly delivered coarse droplet type sprinkling of heated water, thereby accomplsihing a quick and efficient shrinking of said film material about the item wrapped therein, all of which is more specifically illustrated in FIG. 2.

It should be further noted at this point that the exposure time of said items to the heated water medium within the shrinking chamber 18 of said machine 10, in order to accomplish quick and efficient shrinking of heat sensitive film material about said items, without at the same time causing thermal degradation and discoloration of said items, is controllable by four basic machine adjustments. First, the temperature of the heated watershrinking medium 38, although optimally maintained at an operational temperature of 205°F, the same may be adjusted upward or downward by adjusting the temperature, pressure, and amount of live steam admitted to the reservoir 22 of said machine 10 through steam inlet valve coupling 28. Second, the speed of rotation of the recirculation propeller pump 27, which is variably adjustable by means of motor 34, will determine the rate of flow and recirculation of the heated water shrinking medium 38, and thereby provide an additional adjustment for machine 10 to control shrinking chamber exposure time. Third, an additional heated water flow control adjustment means provided by the lateral dimension setting of flanges 48 to control the longitudinal openings through which there is a cascaded discharge 45 of heated water shrinkage medium 38 from distribution tray 44. And, fourth, the control of the transport speed of said items through the shrinking chamber 18 of said machine 10 by adjustment of the variable speed conveyor drive means 17. By distributing and discharging the water in the manner described herein, the temperature of the water is readily maintained at the desired temperature with relatively little heat loss and therefore minimum heat requirements.

Additionally provided as components of said machine 10 are a reservoir drain valve 56, a vapor vent 58, and a removable hatch plate 60 which provides access means to the recirculation system propeller pump 27 for adjustment and maintenance functions. Also provided within the hot water stand pipe 40 is a set of baffles 62 which serve to prevent spiraling or other types of turbulent flow of said hot water shrinking medium 38 within said stand pipe during pumping and recirculation operations, thereby also rendering the simple propeller 27 effective as a pump impeller.

The heat sensitive film shrinking machine 10 herein disclosed is preferably constructed of metal, the preferred metal being stainless steel, but any other suitable material may be used.

The illustration in FIG. 2 is an elevation view of that shown in FIG. 1, and further illustrates the relative positioning of the aformentioned functional sub-assembly components of said machine 10, as well as also showing a plurality of exemplary food product items 64, such as poultry or the like, having been previously wrapped in a heat sensitive film material wherein the same are being transported by means of said linked rod conveyor 16 into and through said shrinking chamber 18 of said machine 10. Also shown is the manner in which the heated water shrinking medium 38 is cascaded from above and also sprinkled from below upon said items 64 which are vacuum wrapped in a heat shrinkable film material.

Figure 3:
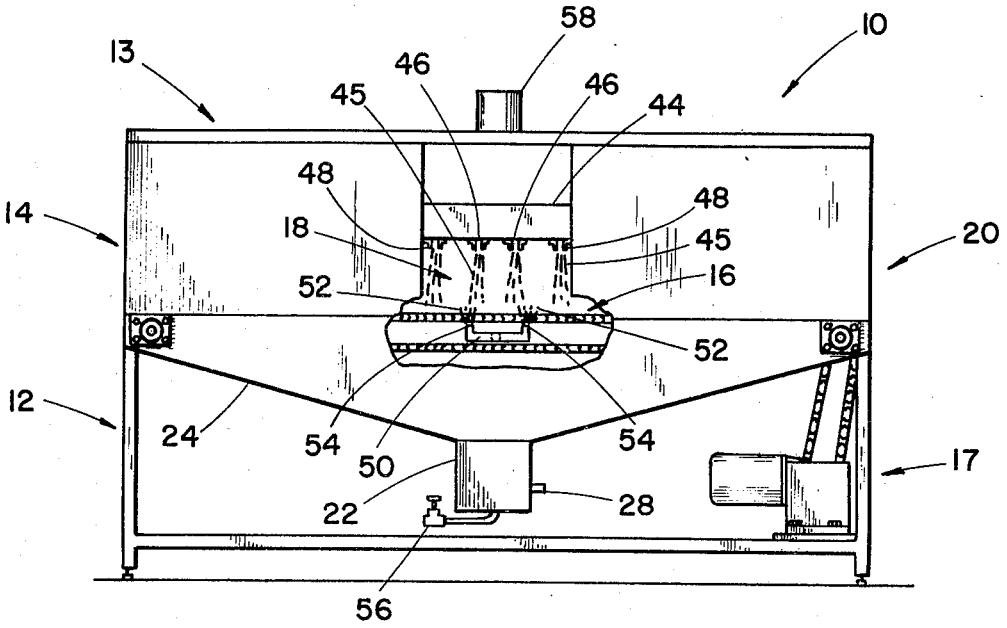
FIG. 3 is a reduced scale view similar to that shown in FIG. 2, but, however, being a side elevation of said machine from the side opposite that shown in FIG. 2.

Referring to FIG. 3, a reduced scale elevation of said machine 10 is illustrated which is opposite to FIG. 2, further showing the respective sub-assembly components thereof as seen from the front of said machine 10 and as heretofore discussed and described.

Figure 4:
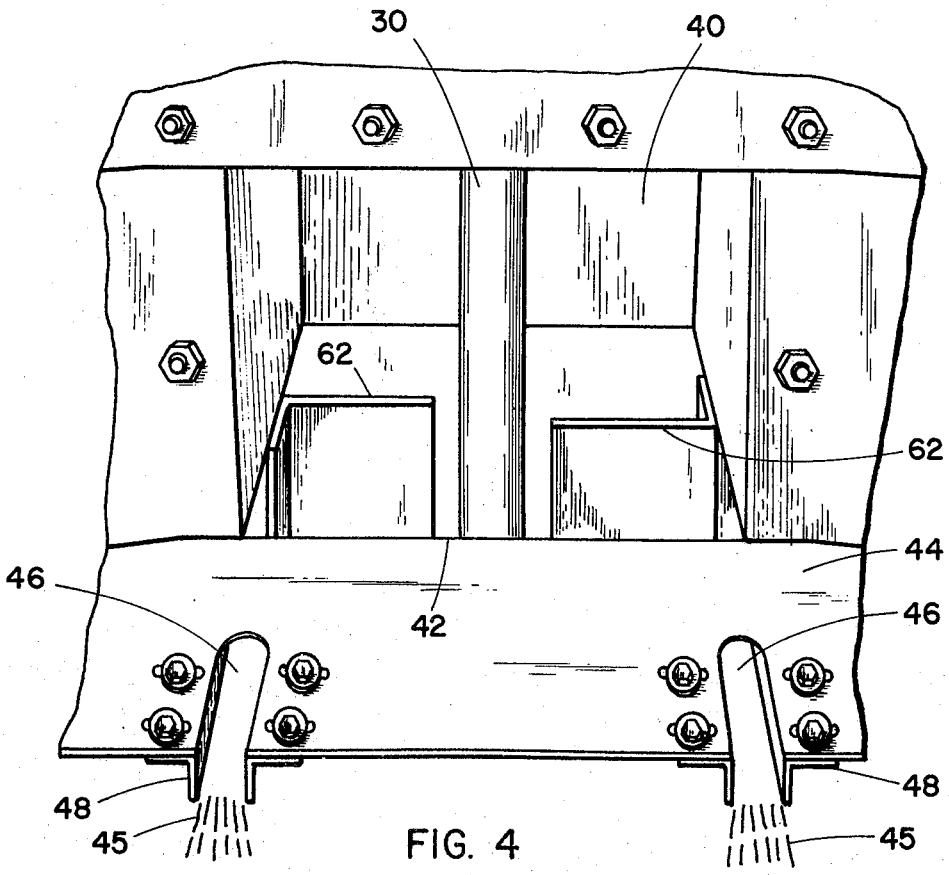
FIG. 4 is a fragmentary enlarged perspective front elevation of the over-flow weir and distribution tray subassemblies of said machine.

The view shown in FIG. 4 is a fragmentary front elevation of the overflow weir 42 and distribution tray 44 sub-assemblies of said machine 10, as well as partially showing the baffles 62 and other sub-assembly components as also heretofore discussed and described.

While the invention has been described and illustrated in its several preferred embodiments, it should be understood that the invention is not to be limited to the precise details herein illustrated and described since the same may be carried out in other ways falling within the scope of the invention as illustrated and described.

We claim:

1. A heat sensitive film shrinking machine having a supporting frame structure of interconnected vertical and horizontal frame members to support units thereof adapted to recirculate and distribute a heated water medium to shrink heat sensitive film about food product items vacuum wrapped therein during a single pass of said items through said machine, a linked rod conveyor means operable to deliver said items unidirectionally in spaced relationship upon said conveyor through a heated water shrinking chamber of said machine, a water collection and heating means comprising a geometrically shaped water collection tray connected to and communicating with a downwardly disposed geometrically shaped reservoir in which water which has been distributed in the machine is collected, means to reheat said collected water to an elevated temperature for recirculation and redistribution to said shrinking chamber for further film shrinking operations, heated water recirculation means comprising a vertically disposed standpipe, a submerged propeller pump centrally positioned within said standpipe at an elevation below the midpoint but above the lower end of said standpipe, means connecting said standpipe to said reservoir to pump heated water from said reservoir and impart a pressure head to the same for distribution to said shrinking chamber, means below said shrinking chamber operable to receive said distributed water for reheating and recirculation thereof, in combination with a heated water distribution means comprised of a fountain manifold connected to and communicating with said standpipe and disposed longitudinally within said shrinking chamber and also laterally across said shrinking chamber in said machine between the delivery and return courses of said linked rod conveyor, whereby said fountain manifold has a plurality of openings in the upper closure surface thereof operable to deliver an upward coarse droplet sprinkling of heated water to the underside surfaces of said items as conveyed through said shrinking chamber, an upper slotted distribution tray connected to and communicating with said stand pipe above the mid-point thereof but below the upper end thereof and longitudinally extending within said shrinking chamber across the lateral dimension thereof and having a series of parallel transverse slots in the bottom of said tray for downwardly cascaded distribution of heated water to the upper surfaces of said items as conveyed through the shrinking chamber of said machine, said slots in said heated water distribution tray being formed by pairs of "L" shaped flanges each of which has one of the legs thereof downwardly disposed and means to adjust at least one of said flanges transversely relative to the other along the bottom of said distribution tray to vary the width of the slot openings in said bottom of said tray and thereby control the amount and pattern of heated water distributed therefrom in cascading manner.

2. The heat sensitive film shrinking machine according to claim 1, wherein said heated water is maintained at an operational temperature level of 205°F.

* * * * *